US006136516A

United States Patent [19]

Fogel et al.

[11] Patent Number: 6,136,516

[45] Date of Patent: Oct. 24, 2000

[54] PROCESS FOR PROCESSING A PHOTOGRAPHIC SILVER HALIDE MATERIAL

[75] Inventors: Thomas Fogel, Strassenhaus; Jürgen Göhmann, Monheim; Norman Klaunzer, Leverkusen, all of Germany

[73] Assignee: Agfa-Gevaert N.V., Belgium

[21] Appl. No.: 09/320,038

[22] Filed: May 26, 1999

[30] Foreign Application Priority Data

Jun. 5, 1998 [DE] Germany ..... 198 25 181

[51] Int. Cl.[7] ..... G03C 7/42

[52] U.S. Cl. ..... 430/393; 430/430; 430/432; 430/943

[58] Field of Search ..... 430/393, 427, 430/430, 432, 943

[56] References Cited

U.S. PATENT DOCUMENTS

| | | | |
|---|---|---|---|
| 4,201,589 | 5/1980 | Sakaguchi et al. | 430/543 |
| 4,301,236 | 11/1981 | Idota et al. | 430/393 |
| 5,691,118 | 11/1997 | Haye | 430/393 |

FOREIGN PATENT DOCUMENTS

| | | |
|---|---|---|
| 678 783 | 10/1995 | European Pat. Off. . |
| 679 945 | 11/1995 | European Pat. Off. . |

*Primary Examiner*—Hoa Van Le
*Attorney, Agent, or Firm*—Connolly, Bove, Lodge & Hutz LLP

[57] ABSTRACT

A process for processing exposed photographic silver halide materials at least comprising the stages color development, stopping, bleaching and fixing using a bleaching bath with hydrogen peroxide as the active substance, characterized in that the stop bath contains as a buffer agent at least one carboxylic acid of the formulae I to VIII (I)

in which $R_1$ to $R_5$ mutually independently mean hydrogen, —OH, —COOM, —$SO_3M$, —$PO(OM)_2$, an optionally substituted alkyl residue, an optionally substituted aryl residue, an optionally substituted amino residue or a heterocyclic residue and M means hydrogen or an alkali metal atom and wherein at least one further acid group is present in the molecule, (II)

(III)

(IV)

(V)

(VI)

(VII)

(VIII)

and at least one agent which stops development, is distinguished by improved bleaching action and the use of an environmentally friendly bleaching bath.

15 Claims, No Drawings

PROCESS FOR PROCESSING A PHOTOGRAPHIC SILVER HALIDE MATERIAL

This invention relates to a process for processing photographic silver halide materials using an environmentally friendly bleaching bath.

When processing photographic silver halide materials, it is necessary to bleach the silver produced on development, ie. to oxidise it to silver ions, which, together with unexposed silver halide, are dissolved out of the material (fixing stage) by means of a silver halide solvent, for example a thiosulfate.

Good bleaches should have the following characteristics:

1. They should rapidly and completely bleach the exposed and developed material.
2. They should not cause any fogging in the photographic material.
3. They should result in quantitative formation of the dyes.
4. They should be biodegradable.
5. They should not dissolve silver ions to form complexes.
6. They should preferably have an adequate bleaching action even in the absence of ammonium ions.

Iron(III) complex compounds of aminopolycarboxylic acids are conventionally used as bleaches, for example complex compounds of ethylenediaminetetraacetic acid (EDTA), propylenediaminetetraacetic acid (PDTA), diethylenetriaminetetraacetic acid (DTPA) or nitrilodiacetic-monopropionic acid (ADA). None of these substances fulfils all of the stated requirements.

Attempts have for some time already been made to achieve efficient bleaching of silver halide materials without costly and environmentally polluting heavy metal complexes.

Apart from peroxides, peroxyborates, peroxycarbonates and peroxycarboxylic acids, which, however, due to the low active peroxide content and the consequent elevated salt loading of the bleaching bath, bleach silver bromide materials in particular only poorly, peroxydisulfates have already been used as bleaches (U.S. Pat. Nos. 2 810 648, 5,460,924).

Bleaching baths with peroxydisulfate require kinetic activation by redox-active components, which, in order to ensure the stability of the bleaching bath, are usually located in a separate preliminary bath. Due to the elevated standard redox potential of peroxydisulfate ($E_0$=2.01 V), large quantities of halide are oxidised in any bleaching baths which contain peroxydisulfate. The chlorine or bromine arising in this manner is either liberated or forms organochlorine or organobromine compounds. In any case, this considerably complicates the handling of these baths.

Hydrogen peroxide is also successfully used as a bleach (EP-A-428 101, WO 92/07300, WO 93/11 459, EP-A-729 065). A fresh $H_2O_2$ bleaching bath exhibits neither the kinetic inhibition of a peroxydisulfate bleaching bath, nor has the potential required for oxidising chloride or bromide. With photographic recording materials predominantly consisting of silver chloride and having a low silver content, known bleaching baths also initially provide an acceptable bleaching action. However, if a $H_2O_2$ bleaching bath is contaminated with substances entrained from the developer bath or diffusing out of the material, some of the bleaching action is lost. Even an upstream conventional stop bath cannot prevent this. One cause for this phenomenon is assumed to be kinetic inhibition of silver oxidation by substances adsorbed on the silver grain (*Research Disclosure* 116 (1973), EP-A-747 764).

The use of hydrogen peroxide as a bleach in combination with various compounds has already been described.

U.S. Pat. No. 4,301,236 discloses a bleaching bath which, in addition to hydrogen peroxide, contains a metal complex compound and an aromatic sulfonic acid. The sulfonic acid is intended to stabilise the hydrogen peroxide. No effect on the bleaching action is observed.

EP-A-678 783 and EP-A-679 945 describe bleaching baths which contain hydrogen peroxide and a sulfonic acid. Addition of the sulfonic acid is intended to prevent blistering on the photographic material during processing. An improvement in bleaching action is also reported. The processing processes which are also described disclose the possibility of including an additional bath, for example a stop bath, between the colour development and bleaching stages. Dilute solutions of sulfuric acid or acetic acid are used as stop baths.

The still poor bleaching action of prior art $H_2O_2$ bleaching baths in the in-service state and the inadequate bleaching of materials predominantly consisting of silver bromide and having an elevated silver content have hitherto prevented these environmentally advantageous bleaching baths from being adopted in favour of bleaching baths containing large quantities of heavy metal complexes.

The object of the present invention was accordingly to provide a process which makes it possible to achieve continuous processing of even hard to bleach photographic materials having an elevated silver content.

While the use of a conventional acidic stop bath in the standard development process completely stops the activity of the entrained developer substance in a bleaching bath having an iron(III) complex compound as the bleach, a conventional acidic stop bath does not achieve this objective in a processing process with an $H_2O_2$ bleaching bath.

This disadvantage cannot be overcome by a longer residence time of the photographic material in the stop bath or by an additional rinsing stage.

The present invention accordingly provides a process for processing exposed photographic silver halide materials at least comprising the stages colour development, stopping, bleaching and fixing using a bleaching bath with hydrogen peroxide as the active substance, characterised in that the stop bath contains as a buffer agent at least one carboxylic acid of the formulae I to VIII (I)

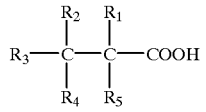

in which $R_1$ to $R_5$ mutually independently mean hydrogen, —OH, —COOM, —$SO_3M$, —$PO(OM)_2$, an optionally substituted alkyl residue, an optionally substituted aryl residue, an optionally substituted amino residue or a heterocyclic residue and M means hydrogen or an alkali metal atom and wherein at least one further acid group is present in the molecule, (II)

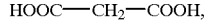

(III)

-continued (IV)

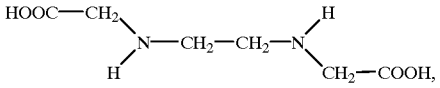

(V)

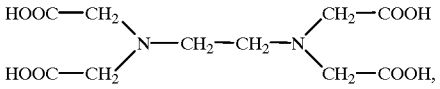

(VI)

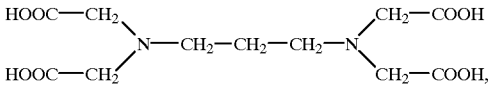

(VII)

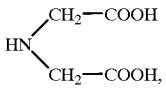

(VIII)

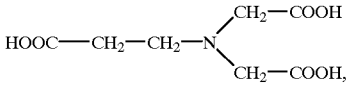

and at least one agent which stops development.

Examples of particularly suitable compounds of the formula I are stated below:

I-1

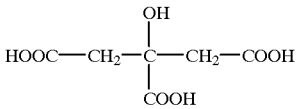

I-2

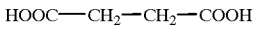

I-3

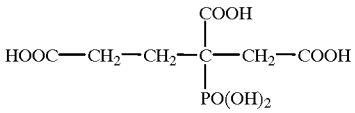

Examples of compounds which stop development are sulfites, bromides, iodides and benzotriazloes. Alkali metal sulfites, bromides and iodides are particularly preferred.

In a preferred embodiment of the invention, the pH value of the stop bath is less than 6.

The buffer agents of the formulate I to VIII are conventionally used in the stop bath in a concentration of 100 to 2000 mmol/l. In a preferred embodiment, the stop bath contains the buffer agents in a quantity of 300 to 1000 mmol/l.

The agents which stop development are conventionally used in the stop bath in a concentration of 0.01 to 200 mmol/l. In a preferred embodiment the stop bath contains these agents in a quantity of 0.1 to 100 mmol/l.

The process according to the invention is in particular suitable for processing colour photographic silver halide recording materials which contain on a reflective or transparent support (for example paper coated on both sides with polyethylene or cellulose triacetate film) at least one blue-sensitive, at least one green-sensitive and at least one red-sensitive silver halide emulsion layer, with which are associated in the stated sequence at least one yellow coupler, at least one magenta coupler and at least one cyan coupler.

Details of suitable silver halide emulsions, the production, ripening, stabilisation and spectral sensitisation thereof, including suitable spectral sensitisers, may be found in *Research Disclosure* 37254, part 3 (1995), p. 286, in *Research Disclosure* 37038, part XV (1995), p.98 and in *Research Disclosure* 38957, part V.A (1996), p.603.

Photographic materials having camera sensitivity conventionally contain silver bromide-iodide emulsions, which may optionally contain small proportions of silver chloride. Photographic print materials contain either silver chloride-bromide emulsions containing up to 80 mol % AgBr or silver chloride-bromide emulsions containing more than 95 mol % AgCl.

Further details of conventional procedures and chemicals required for this purpose are disclosed in *Research Disclosure* 37254, part 10 (1995), p. 294 and in *Research Disclosure* 37038, parts XVI to XXIII (1995), pp. 95 et seq. together with example materials.

The processing process may be performed continuously with constant replenishment of the individual processing baths.

Example 1

(Processing of Colour Negative Paper)

A colour photographic recording material was produced by applying the following layers in the stated sequence onto a film support of paper coated on both sides with polyethylene. All quantities are stated per 1 $m^2$. The silver halide application rate is stated as the corresponding quantities of $AgNO_3$.

Layer 1: (Substrate layer)

0.10 g of gelatine

Layer 2: (Blue-sensitive layer)

Blue-sensitised silver halide emulsion (99.5 mol % chloride, 0.5 mol % bromide, average grain diameter 0.9 μm) prepared from 0.50 g of $AgNO_3$ with
0.70 mg of blue sensitiser BS-1
0.30 mg of stabiliser ST-1
1.25 g of gelatine
0.55 g of yellow coupler Y-1
0.10 g of image stabiliser BST-1
0.50 g of oil former OF-1

Layer 3: (Interlayer)

1.10 g of gelatine
0.60 g of DOP scavenger EF-1
0.06 g of DOP scavenger EF-2
0.12 g of tricresyl phosphate (TCP)

Layer 4: (Green-sensitive layer)

Green-sensitised silver halide emulsion (99.5 mol % chloride, 0.5 mol % bromide, average grain diameter 0.47 μm) prepared from 0.40 g of $AgNO_3$ with
0.70 mg of green stabiliser GS-1
0.50 mg of stabiliser ST-2
0.77 g of gelatine
0.41 g of magenta coupler M-1
0.06 g of image stabiliser BST-2
0.12 g of DOP scavenger EF-2
0.34 g of dibutyl phthalate (DBP)

Layer 5: (UV protective layer)

0.95 g of gelatine
0.50 g of UV absorber UV-1

-continued

| | | |
|---|---|---|
| | 0.03 g | of DOP scavenger EF-1 |
| | 0.03 g | of DOP scavenger EF-2 |
| | 0.15 g | of oil former OF-2 |
| | 0.15 g | of TCP |
| Layer 6: | (Red-sensitive layer) | |
| | Red-sensitised silver halide emulsion (99.5 mol % chloride, 0.5 mol % bromide, average grain diameter 0.5 μm) prepared from 0.30 g of $AgNO_3$ with | |
| | 0.03 mg | of red sensitiser RS-1 |
| | 0.60 mg | of stabiliser ST-3 |
| | 1.00 g | of gelatine |
| | 0.46 g | of cyan coupler C-1 |
| | 0.46 g | of TCP |

-continued

| | | |
|---|---|---|
| Layer 7: | (UV protective layer) | |
| | 0.30 g | of gelatine |
| | 0.20 g | of UV absorber UV-1 |
| | 0.10 g | of oil former OF-3 |
| Layer 8: | (Protective layer) | |
| | 0.90 g | of gelatine |
| | 0.05 g | of optical brightener WT-1 |
| | 0.07 g | of mordant (polyvinylpyrrolidone) |
| | 1.20 mg | of silicone oil |
| | 2.50 mg | of spacers (polymethyl methacrylate, average particle size 0.8 μm) |
| | 0.30 g | of hardener H-1 |

Compounds used in layer structure 1:

BS-1

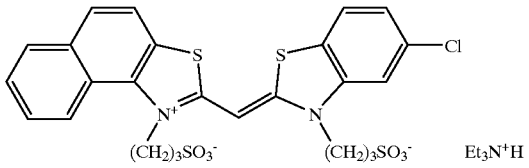

GS-1

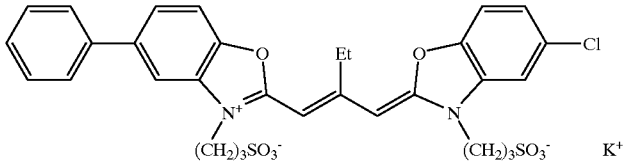

RS-1

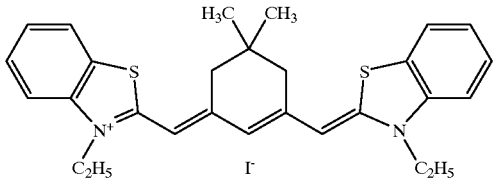

ST-1

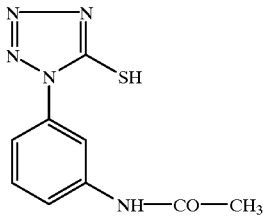

ST-2

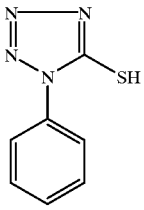

ST-3

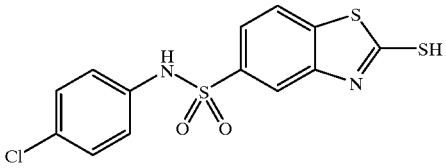

-continued
Y-1
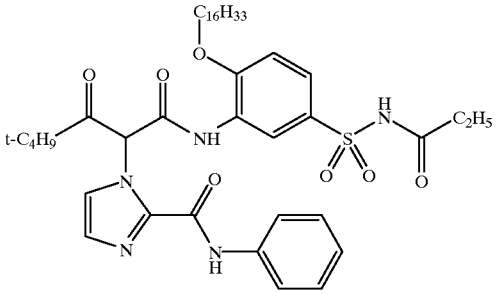
M-1
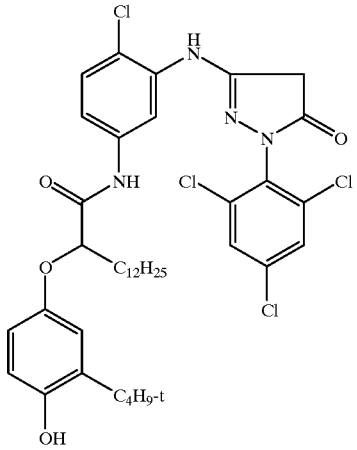
C-1
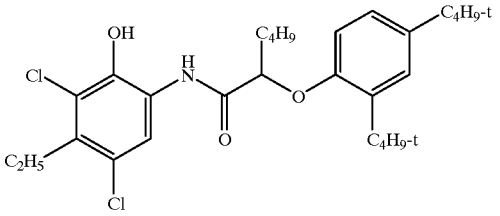
BST-1
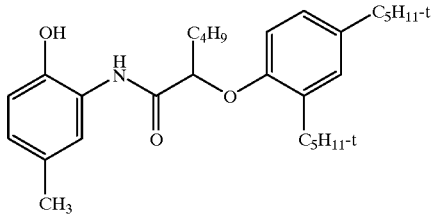
BST-2
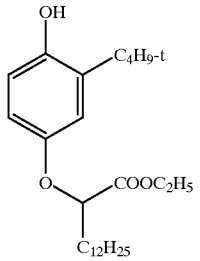
EF-1
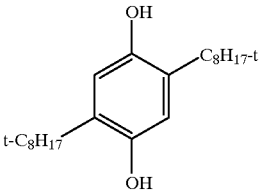
EF-2
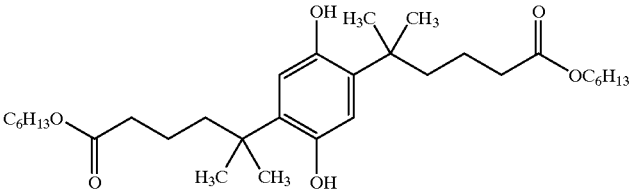
OF-1
Polyester prepared from HOOC—$(CH_2)_4$—COOH, η (20° C.): 4000–5000 mPa•s
HO—$CH_2$—$C(CH_3)_2$—$CH_2$—OH and $C_{10}H_{21}$-i $n_D$ (20° C.): 1.464–1.467
OF-2
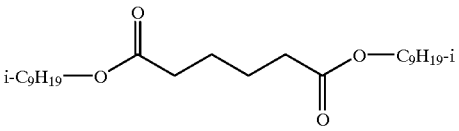
OF-3
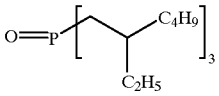

-continued

UV-1

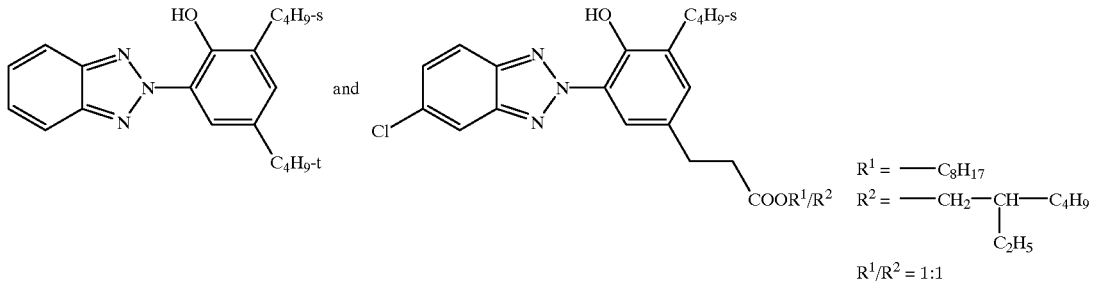

in a 90:10 weight ratio

WT-1

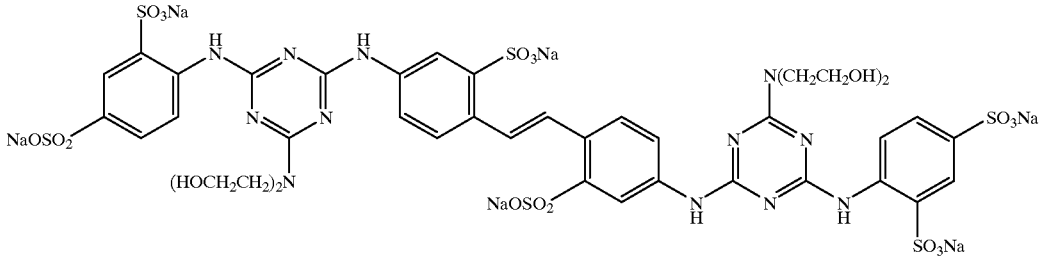

H-1

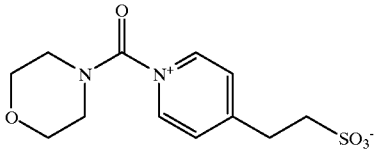

The colour photographic material was dried, exposed with an image through a step wedge in a sensitometer and processed under the following conditions:

| Bath | Temperature | Time | Replenishment rate |
|---|---|---|---|
| Developer | 37° C. | 33 s | 60 ml/m$^2$ |
| Stop | 30° C. | see table 1 | 300 ml/m$^2$ |
| Bleaching | 37° C. | 33 s | 200 ml/m$^2$ |
| Fixing | 37° C. | 33 s | 120 ml/m$^2$ |
| Stabilising | 37° C. | 60 s | 120 ml/m$^2$ |

The individual processing baths were of the following composition:

| Colour developer bath (formulation for 1 liter) | |
|---|---|
| Water | 800 ml |
| Diethylenetriaminepentaacetic acid | 10 mmol |
| Hydroxyethanediphosphonic acid | 0.2 mmol |
| N,N-diethylhydroxylamine | 35 mmol |
| CD-3 | 13.7 mmol |
| Potassium chloride | 43 mmol |
| Potassium carbonate | 160 mmol |
| Optical brightener (4,4'-diaminostilbenesulfonic acid derivative) | 1 mmol |
| pH value | 10.3 |
| Stop bath (formulation for 1 liter) | |
| Water | 800 ml |
| Compound I-3 | 300 mmol |
| Sodium sulfite | 100 mmol |

-continued

| | |
|---|---|
| Potassium bromide | 5 mmol |
| Hydroxyethanediphosphonic acid | 20 mmol |
| pH value | 5 |
| Bleaching bath (formulation for 1 liter) | |
| Water | 800 ml |
| Diethylenetriaminepentaacetic acid | 1 mmol |
| Hydroxyethanediphosphonic acid | 0.1 mmol |
| Sodium dihydrogen phosphate | 30 mmol |
| Sodium chloride | 15 mmol |
| Hydrogen peroxide | 300 mmol |
| pH value | 4 |
| Fixing bath (formulation for 1 liter) | |
| Water | 800 ml |
| Ammonium thiosulfate | 250 mmol |
| Sodium sulfite | 200 mmol |
| Sodium hydrogen carbonate | 400 mmol |
| Ethylenediaminetetraacetic acid | 1.5 mmol |
| pH value | 7 |
| Stabilising bath (formulation for 1 liter) | |
| Water | 800 ml |
| Hydroxyethanediphosphonic acid | 0.2 mmol |
| Sodium benzoate | 5 mmol |
| Acetic acid | 150 mmol |
| Ethylenediaminetetraacetic acid | 2 mmol |
| pH value | 5 |

After processing, the minimum optical density $D_{min}$ yellow of the photographic material was determined with a densitometer.

Comparison was provided by rinsing (30° C., pH 7, replenishment rate: 300 ml/m$^2$) or a conventional stop bath instead of the stop bath according to the invention.

| Conventional stop bath (formulation for 1 liter) | |
|---|---|
| Water | 800 ml |
| Acetic acid | 525 mmol |
| Hydroxyethanediphosphonic acid | 200 mmol |
| Ethylenediaminetetraacetic acid | 2 mmol |
| pH value | 3.4 |

Using the processing process according to the invention, it is possible to achieve a considerable reduction in processing time combined with good bleaching and improved $D_{min}$ values. Table 1 shows the results.

TABLE 1

| Processing process | Time [s] | $D_{min}$yellow | Comparison/ Invention |
|---|---|---|---|
| Rinsing | 400 | 0.142 | Comparison |
| Rinsing | 60 | 0.157 | Comparison |
| Conventional stop bath | 400 | 0.139 | Comparison |
| Conventional stop bath | 60 | 0.145 | Comparison |
| Stop bath according to the invention | 180 | 0.120 | Invention |
| Stop bath according to the invention | 120 | 0.123 | Invention |
| Stop bath according to the invention | 60 | 0.125 | Invention |

Example 2

(Processing of Colour Negative Paper)

The colour photographic recording material from Example 1 was dried, exposed with an image through a step wedge in a sensitometer and processed as described in Example 1. The colour developer bath, bleaching bath, fixing bath and stabilising bath from Example 1 were used for processing. The stop bath was of the following composition:

| Stop bath (formulation for 1 liter) | |
|---|---|
| Water | 800 ml |
| Compound I-3 | 350 mmol |
| Potassium bromide | 50 mmol |
| Hydroxyethanediphosphonic acid | 20 mmol |
| pH value | 4 |

Comparison was provided by rinsing (30° C., pH 7, replenishment rate: 300 ml/$m^2$) or the conventional stop bath from Example 1 instead of the stop bath according to the invention.

Using the processing process according to the invention, it is possible to achieve a considerable reduction in processing time combined with good bleaching and improved $D_{min}$ values. Table 2 shows the results.

TABLE 2

| Processing process | Time [s] | $D_{min}$yellow | Comparison/ Invention |
|---|---|---|---|
| Rinsing | 400 | 0.142 | Comparison |
| Rinsing | 60 | 0.157 | Comparison |
| Conventional stop bath | 400 | 0.139 | Comparison |
| Conventional stop bath | 60 | 0.145 | Comparison |

TABLE 2-continued

| Processing process | Time [s] | $D_{min}$yellow | Comparison/ Invention |
|---|---|---|---|
| Stop bath according to the invention | 180 | 0.122 | Invention |
| Stop bath according to the invention | 120 | 0.124 | Invention |
| Stop bath according to the invention | 60 | 0.125 | Invention |

Example 3

(Processing of colour negative film)

The colour photographic recording material was produced by applying the following layers in the stated sequence onto a transparent cellulose triacetate film support. All quantities are stated per 1 $m^2$. The silver halide application rate is stated as the corresponding quantities of $AgNO_3$; the silver halides are stabilised with 0.5 g of 4-hydroxy-6-methyl-1, 3,3a,7-tetraazaindene per mol. of $AgNO_3$.

| | |
|---|---|
| | 1st layer (Anti-halo layer) |
| 0.3 g | of black colloidal silver |
| 1.2 g | of gelatine |
| 0.3 g | of UV absorber UV-1 |
| 0.2 g | of DOP (developer oxidation product) scavenger SC-1 |
| 0.02 g | of tricresyl phosphate (TCP) |
| | 2nd layer (Low sensitivity, red-sensitive layer) |
| 0.7 g | of $AgNO_3$ of a spectrally red-sensitised AgBrI emulsion, 4 mol % iodide, average grain diameter 0.42 μm |
| 1 g | of gelatine |
| 0.35 g | of colourless coupler C-1 |
| 0.05 g | of coloured coupler RC-1 |
| 0.03 g | of coloured coupler YC-1 |
| 0.36 g | of TCP |
| | 3rd layer (Medium sensitivity, red-sensitive layer) |
| 0.8 g | of $AgNO_3$ of a spectrally red-sensitised AgBrI emulsion, 5 mol % iodide, average grain diameter 0.53 μm |
| 0.6 g | of gelatine |
| 0.15 g | of colourless coupler C-2 |
| 0.03 g | of coloured coupler RC-1 |
| 0.02 g | of DIR coupler D-1 |
| 0.18 g | of TCP |
| | 4th layer (High sensitivity, red-sensitive layer) |
| 1 g | of $AgNO_3$ of a spectrally red-sensitised AgBrI emulsion, 6 mol % iodide, average grain diameter 0.85 μm |
| 1 g | of gelatine |
| 0.1 g | of colourless coupler C-2 |
| 0.005 g | of DIR coupler D-2 |
| 0.11 g | of TCP |
| | 5th layer (Interlayer) |
| 0.8 g | of gelatine |
| 0.07 g | of DOP scavenger SC-2 |
| 0.06 g | of aurintricarboxylic acid aluminium salt |
| | 6th layer (Low sensitivity, green-sensitive layer) |
| 0.7 g | of $AgNO_3$ of a spectrally green-sensitised AgBrI emulsion, 4 mol % iodide, average grain diameter 0.35 μm |
| 0.8 g | of gelatine |
| 0.22 g | of colourless coupler M-1 |
| 0.065 g | of coloured coupler YM-1 |
| 0.02 g | of DIR coupler D-3 |
| 0.2 g | of TCP |
| | 7th layer (Medium sensitivity, green-sensitive layer) |
| 0.9 g | of $AgNO_3$ of a spectrally green-sensitised AgBrI emulsion, 4 mol % iodide, average grain diameter 0.50 μm |
| 1 g | of gelatine |
| 0.16 g | of colourless coupler M-1 |

-continued

| | | |
|---|---|---|
| 0.04 | g | of coloured coupler YM-1 |
| 0.015 | g | of DIR coupler D-4 |
| 0.14 | g | of TCP |
| | | 8th layer (High sensitivity, green-sensitive layer) |
| 0.6 | g | of $AgNO_3$ of a spectrally green-sensitised AgBrI emulsion, 6 mol % iodide, average grain diameter 0.70 μm |
| 1.1 | g | of gelatine |
| 0.05 | g | of colourless coupler M-2 |
| 0.01 | g | of coloured coupler YM-2 |
| 0.02 | g | of DIR coupler D-5 |
| 0.08 | g | of TCP |
| | | 9th layer (Yellow filter layer) |
| 0.09 | g | of yellow dye GF-1 |
| 1 | g | of gelatine |
| 0.08 | g | of DOP scavenger SC-2 |
| 0.26 | g | of TCP |
| | | 10th layer (Low sensitivity, blue-sensitive layer) |
| 0.3 | g | of $AgNO_3$ of a spectrally blue-sensitised AgBrI emulsion, 6 mol % iodide, average grain diameter 0.44 μm |
| 0.5 | g | of $AgNO_3$ of a spectrally blue-sensitised AgBrI emulsion, 6 mol % iodide, average grain diameter 0.50 μm |
| 1.9 | g | of gelatine |
| 1.1 | g | of colourless coupler Y-1 |
| 0.037 | g | of DIR coupler D-6 |
| 0.6 | g | of TCP |

-continued

| | | |
|---|---|---|
| | | 11th layer (High sensitivity, blue-sensitive layer) |
| 0.6 | g | of $AgNO_3$ of a spectrally blue-sensitised AgBrI emulsion, 7 mol % iodide, average grain diameter 0.95 μm |
| 1.2 | g | of gelatine |
| 0.1 | g | of colourless coupler Y-1 |
| 0.006 | g | of DIR coupler D-7 |
| 0.11 | g | of TCP |
| | | 12th layer (Micrate layer) |
| 0.1 | g | of $AgNO_3$ of a micrate AgBrI emulsion, 0.5 mol % iodide, average grain diameter 0.06 μm |
| 1 | g | of gelatine |
| 0.004 | mg | of $K_2[PdCl_4]$ |
| 0.4 | g | of UV absorber UV-2 |
| 0.3 | g | of TCP |
| | | 13th layer (Protective & hardening layer) |
| 0.25 | g | of gelatine |
| 0.75 | g | of hardener H-1 |

Once hardened, the overall layer structure had a swelling factor of ≦3.5.

Substances used in Example 3:

UV-1

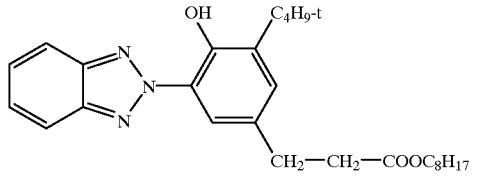

UV-2

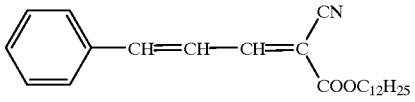

C-1

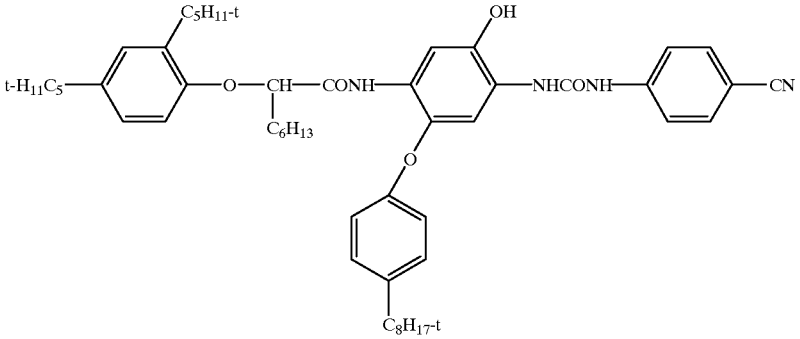

C-2

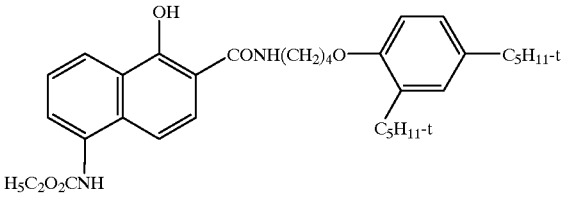

-continued
RC-1
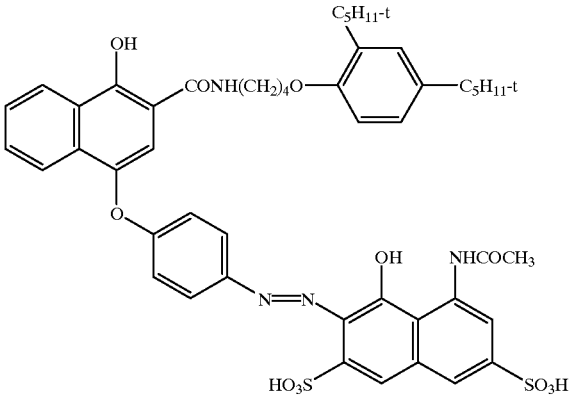
YC-1
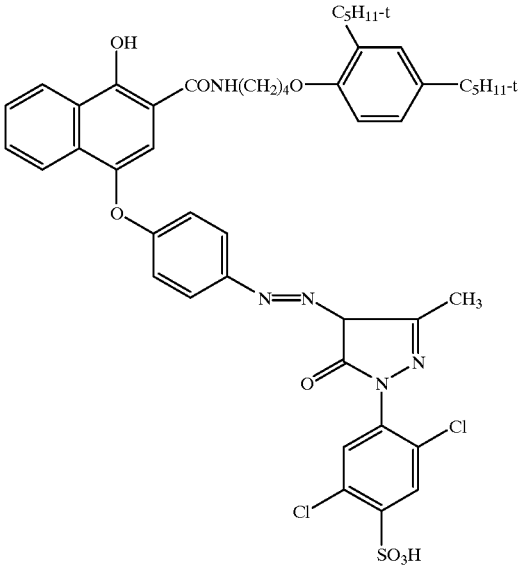
M-1
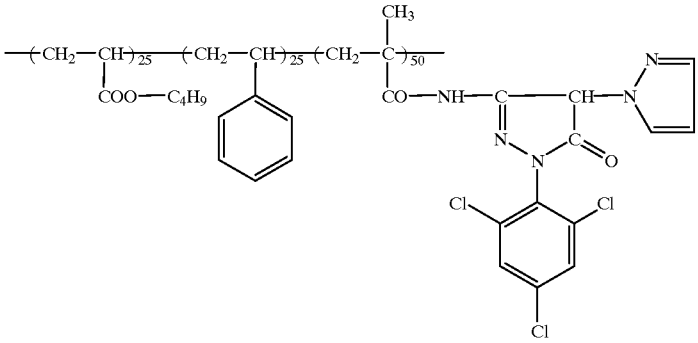

-continued
M-2
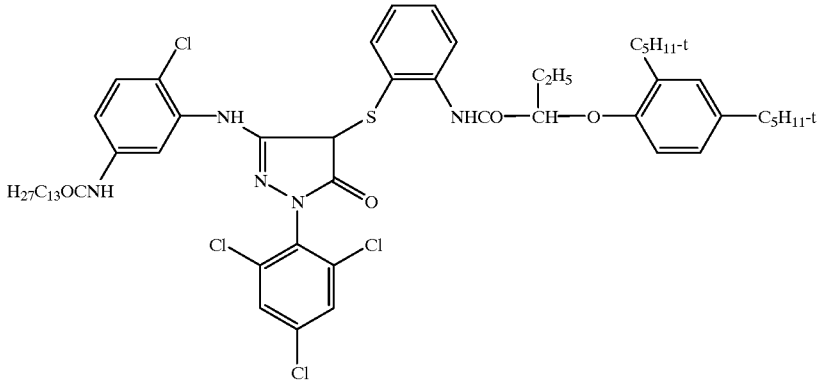
YM-1
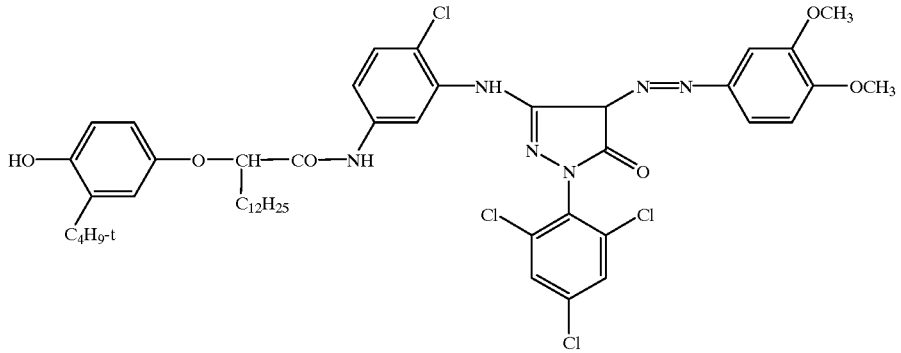
YM-2
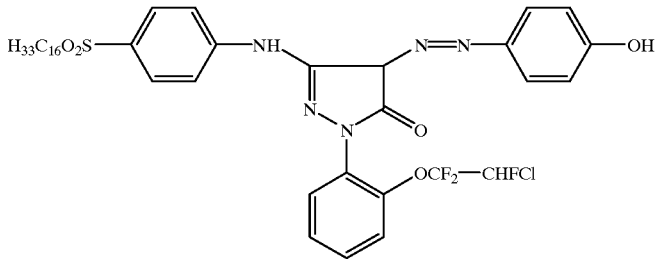
Y-1
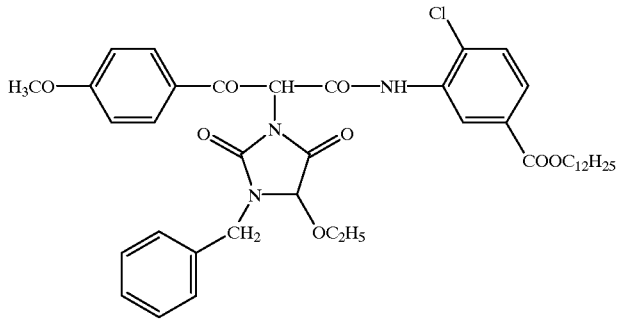

-continued
D-1
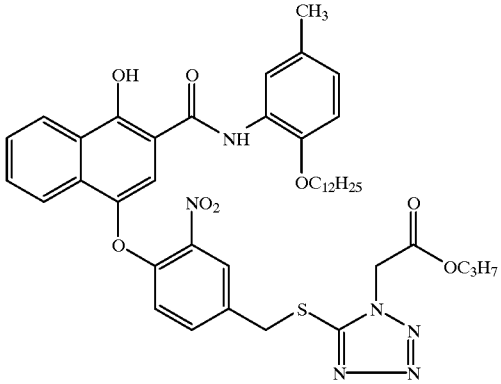
D-2
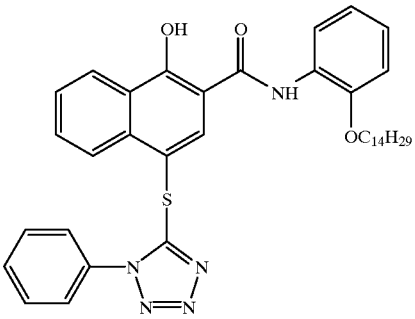
D-3
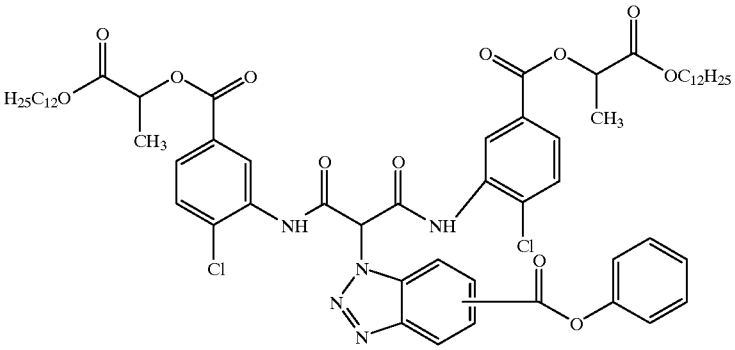
D-4
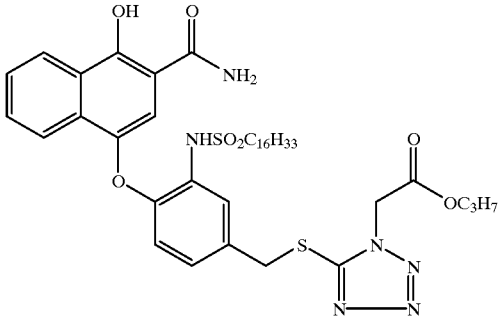
D-5
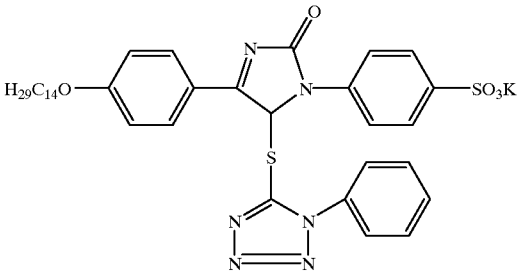
D-6
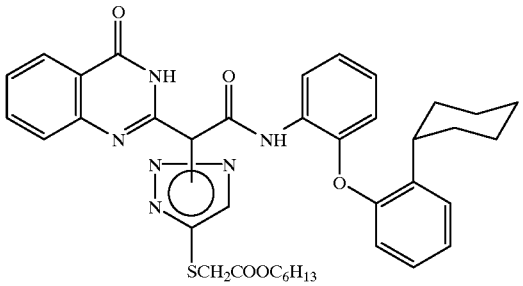
D-7
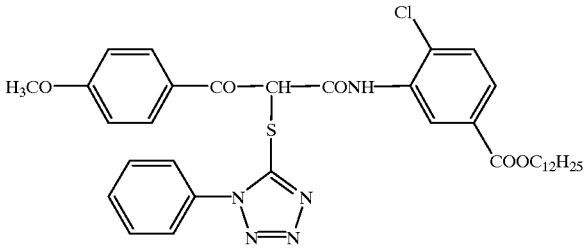
SC-1
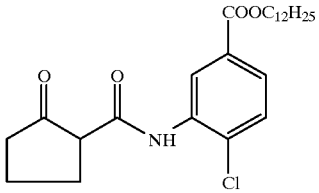

-continued

SC-2

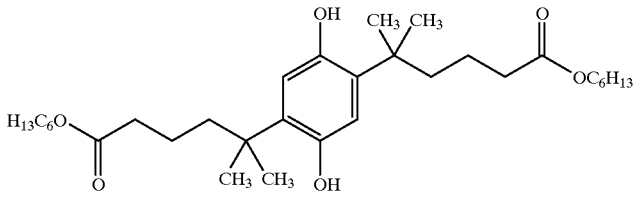

GF-1

H-1

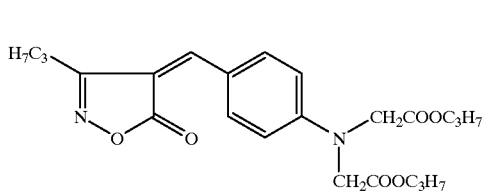

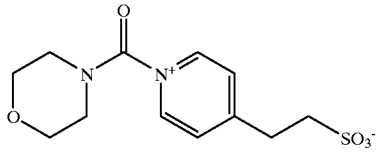

The colour photographic material was dried, exposed with an image through a step wedge in a sensitometer and processed under the following conditions:

| Bath | Temperature | Time | Replenishment rate |
|---|---|---|---|
| Developer | 37.8° C. | 195 s | 640 ml/m$^2$ |
| Stop | 35° C. | see table 3 | 400 ml/m$^2$ |
| Bleaching | 35° C. | 180s | 400 ml/m$^2$ |
| Fixing | 35° C. | 90s | 300 ml/m$^2$ |
| Stabilising | 35° C. | 120 s | 2000 ml/m$^2$ |

The individual processing baths were of the following composition:

| Colour developer bath (formulation for 1 liter) | |
|---|---|
| Water | 800 ml |
| Diethylenetriaminepentaacetic acid | 1 mmol |
| Hydroxyethanediphosphonic acid | 0.2 mmol |
| Potassium carbonate | 170 mmol |
| Sodium sulfite | 34 mmol |
| Potassium iodide | $7.2 \times 10^{-3}$ mmol |
| Sodium bromide | 13 mmol |
| Hydroxylamine sulfate | 14 mmol |
| CD-4 | 15 mmol |
| pH value | 10.3 |
| Stop bath (formulation for 1 liter) | |
| Water | 800 ml |
| Compound I-3 | 300 mmol |
| Sodium sulfite | 50 mmol |
| Potassium bromide | 5 mmol |
| Hydroxyethanediphosphonic acid | 20 mmol |
| pH value | 5 |
| Bleaching bath (formulation for 1 liter) | |
| Water | 800 ml |
| Diethylenetriaminepentaacetic acid | 10 mmol |
| Hydroxyethanediphosphonic acid | 0.1 mmol |
| Sodium dihydrogen phosphate | 30 mmol |
| Sodium chloride | 35 mmol |
| Hydrogen peroxide | 700 mmol |
| pH value | 8 |
| Fixing bath (formulation for 1 liter) | |
| Water | 800 ml |
| Ammonium thiosulfate | 500 mmol |
| Ammonium thiocyanate | 500 mmol |

-continued

| | |
|---|---|
| Sodium sulfite | 400 mmol |
| Sodium hydrogen carbonate | 400 mmol |
| Ethylenediaminetetraacetic acid | 2 mmol |
| pH value | 7.5 |
| Stabilising bath (formulation for 1 liter) | |
| Water | 800 ml |
| Hydroxyethanediphosphonic acid | 0.2 mmol |
| Polyoxyethylene p-nonylphenyl ether | 0.05 mmol |
| pH value | 5 |

After processing, the minimum optical density $D_{min}$yellow of the photographic material was determined with a densitometer.

Comparison was provided by rinsing (30° C., pH 7, replenishment rate: 300 ml/m$^2$) or the conventional stop bath from Example 1 instead of the stop bath according to the invention.

Using the processing process according to the invention, it is possible to achieve a considerable reduction in processing time combined with good bleaching and improved $D_{min}$ values. Table 3 shows the results.

TABLE 3

| Processing process | Time [s] | $D_{min}$yellow | Comparison/ Invention |
|---|---|---|---|
| Rinsing | 400 | 0.092 | Comparison |
| Rinsing | 60 | 0.106 | Comparison |
| Conventional stop bath | 400 | 0.092 | Comparison |
| Conventional stop bath | 60 | 0.104 | Comparison |
| Stop bath according to the invention | 180 | 0.076 | Invention |
| Stop bath according to the invention | 120 | 0.077 | Invention |
| Stop bath according to the invention | 60 | 0.079 | Invention |

Example 4

(Processing of Colour Negative Film)

The colour photographic recording material from Example 3 was dried, exposed with an image through a step wedge in a sensitometer and processed as described in Example 3. The colour developer bath, bleaching bath, fixing bath and stabilising bath from Example 3 were used for processing. The stop bath was of the following composition:

| Stop bath (formulation for 1 liter) | |
|---|---|
| Water | 800 ml |
| Compound I-3 | 350 mmol |
| Potassium iodide | 1 mmol |
| Hydroxyethanediphosphonic acid | 20 mmol |
| pH value | 4 |

Comparison was provided by rinsing (30° C., pH 7, replenishment rate: 300 ml/m$^2$) or the conventional stop bath from Example 1 instead of the stop bath according to the invention.

Using the processing process according to the invention, it is possible to achieve a considerable reduction in processing time combined with good bleaching and improved $D_{min}$ values. Table 4 shows the results.

TABLE 4

| Processing process | Time [s] | $D_{min}$yellow | Comparison/ Invention |
|---|---|---|---|
| Rinsing | 400 | 0.092 | Comparison |
| Rinsing | 60 | 0.106 | Comparison |
| Conventional stop bath | 400 | 0.092 | Comparison |
| Conventional stop bath | 60 | 0.104 | Comparison |
| Stop bath according to the invention | 180 | 0.075 | Invention |
| Stop bath according to the invention | 120 | 0.076 | Invention |
| Stop bath according to the invention | 60 | 0.079 | Invention |

Compounds used in the Examples:

CD3

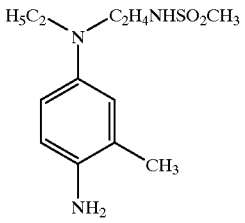

CD4

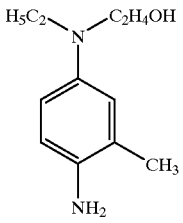

What is claimed is:

1. Process for processing exposed photographic silver halide materials at least comprising the stages color development, stopping, bleaching and fixing using a bleaching bath with hydrogen peroxide as the active substance, and the stop bath contains as a buffer agent at least one carboxylic acid of the formulae I to VIII (I)

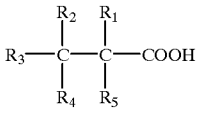

in which $R_1$ to $R_5$ mutually independently mean hydrogen, —OH, —COOM, —$SO_3M$, —$PO(OM)_2$, an optionally substituted alkyl residue, an optionally substituted aryl residue, an optionally substituted amino residue or a heterocyclic residue and M means hydrogen or an alkyli metal atom and wherein at least one further acid group is present in the molecule,

HOOC—$CH_2$—COOH, (II)

HOOC—CH=CH—COOH, (III)

(IV)

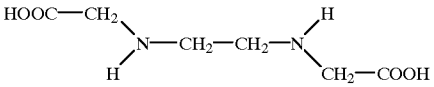

(V)

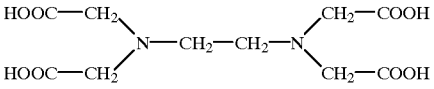

(VI)

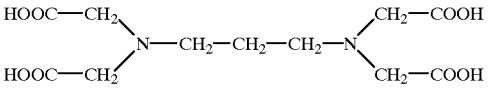

(VII)

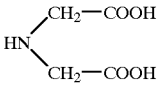

(VIII)

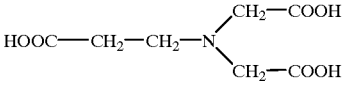

and at least one agent which stops development.

2. Process according to claim 1, wherein the substance which stops development is a sulfite, bromide, iodide or benzotriazole.

3. Process according to claim 1, wherein the pH value of the stop bath is less than 6.

4. Process according to claim 1, wherein the stop bath contains the buffer agents of the formulae I to VIII in a quantity of 300 to 1000 mmol/l.

5. Process according to claim 1, wherein the stop bath contains the agents which stop development in a quantity of 0.1 to 100 mmol/l.

6. The process according to claim 1, wherein the compounds of formula I are present and are selected from the group consisting of

I-1

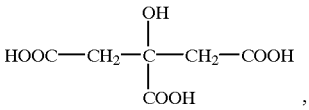

,

I-2

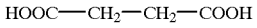

and

I-3

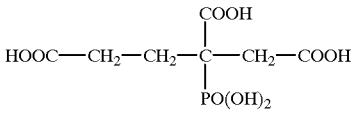

.

7. The process according to claim 2, wherein the substance which stops the development is an alkali metal sulphite.

8. The process according to claim 2, wherein the substance which stops the development is a bromide or an iodide.

9. The process according to claim 1, wherein the stop bath contains buffering agents of the formulae from I to VIII in a concentration of 100 to 2,000 mmol/l.

10. The process according to claim 2, wherein the stop bath contains the agents which stop the development in a concentration of 0.01 to 200 mmol/l.

11. The process as claimed in claim 1, wherein said stop bath is provided between the development and bleaching.

12. The process as claimed in claim 1, where there is one stop bath stage.

13. The process as claimed in claim 1, wherein said stop bath consists essentially of water, said compound of the formula I and said one agent which stops development.

14. The process as claimed in claim 1, wherein said stop bath consists essentially of water, said compound of the formula 1, said one agent which stops development and hydroxyethanediphosphonic acid.

15. The process as claimed in claim 1, wherein said stop bath consists of water, said compound of the formula 1, said one agent which stops development and hydroxyethanediphosphonic acid.

* * * * *